United States Patent [19]

Bryant

[11] Patent Number: 4,838,752

[45] Date of Patent: Jun. 13, 1989

[54] FORKLIFT ATTACHMENT FOR DUMPING CONTAINERS

[75] Inventor: Harold C. Bryant, Kennewick, Wash.

[73] Assignee: Columbia Equipment, Inc., Pasco, Wash.

[21] Appl. No.: 167,353

[22] Filed: Mar. 14, 1988

[51] Int. Cl.[4] ..... B66F 9/06

[52] U.S. Cl. ..... 414/421; 414/607

[58] Field of Search ..... 414/607, 608, 425, 620, 414/621, 622, 419, 421, 422; 298/17 R

[56] References Cited

U.S. PATENT DOCUMENTS

| | | | |
|---|---|---|---|
| 2,678,742 | 5/1954 | Zorn . | |
| 3,283,933 | 11/1966 | Vander Wal . | |
| 3,307,724 | 3/1967 | Miller . | |
| 3,455,476 | 7/1969 | Grigsby | 414/607 |
| 3,486,648 | 12/1969 | De Wald . | |
| 3,613,924 | 10/1971 | Monson . | |
| 3,656,643 | 4/1972 | Keneson et al. . | |
| 3,877,593 | 4/1975 | Sleziak . | |
| 3,984,017 | 10/1976 | Giles . | |
| 4,036,383 | 7/1977 | Allen . | |
| 4,272,217 | 6/1981 | Sefcik . | |
| 4,405,278 | 9/1983 | Kvalheim . | |

FOREIGN PATENT DOCUMENTS

| | | | |
|---|---|---|---|
| 2380174 | 10/1978 | France | 414/421 |
| 1066650 | 4/1967 | United Kingdom | 414/422 |

*Primary Examiner*—Robert J. Spar
*Assistant Examiner*—Robert S. Katz
*Attorney, Agent, or Firm*—Christensen, O'Connor, Johnson & Kindness

[57] ABSTRACT

Safety mechanism for forklift attachment, prevents the premature dumping of a container residing on the attachment in situations where the container is not adequately secured to the attachment because of operator error or nonuniform size containers.

13 Claims, 4 Drawing Sheets

FORKLIFT ATTACHMENT FOR DUMPING CONTAINERS

BACKGROUND OF THE INVENTION

The present invention relates to an attachment for powered vehicles, such as a forklift and, more particularly, to an attachment adapted for lifting, carrying and dumping individual containers.

The use of attachments on powered vehicles for emptying containers by dumping their contents is known. Hydraulic and power take-off driven dumping attachments are available for emptying open-topped containers. Other types of attachments for dumping containers are also known that do not require the hydraulic or power take-off drive. Some of these known attachments include a container that is not independent of the attachment but, is an integral part thereof. Other attachments provide an apparatus for lifting and carrying, as well as emptying containers that are structurally independent of the attachment.

In certain applications, such as fruit and produce harvesting, it is advantageous to empty large open-topped containers that are independent of the attachment by tipping the container over so the contents will fall out. While this is an effective means of emptying the containers, conventional forklift attachments suffer from the drawback that operator error or nonuniform size containers can result in the container being less than securely carried on the attachment, particularly when the container is tipped for emptying. Obviously, when the container resides less than securely on the attachment, the operators in close proximity to the forklift are endangered due to the possibility of the container falling off of the attachment. Of less concern, but equally possible, is the potential for damage to surrounding equipment and the contents of the container if the container falls off of the attachment.

Conventional forklift dumping attachments do not provide a means for safely tipping and emptying independent, individual containers. Therefore, with the increasing concern for employee safety, it is imperative that employers do everything within their means to prevent employees from being exposed to unnecessary risks. Thus, there is a continuing interest in providing a safe and effective attachment for powered vehicles to lift, carry and empty large containers.

SUMMARY OF THE INVENTION

The present invention is a container dumping apparatus for attachment to a powered vehicle, such as a forklift. The apparatus includes a base frame suitable for mounting on the forks of a forklift and a carriage pivotally mounted on the base frame such that the weight of the container will cause the carriage to tip forward, thus emptying the container. The upper surface of the carriage is capable of receiving a container of predetermined size which is securely held on the carriage by retaining arms mounted on the front end of the carriage. The retaining arms are moveable between a retracted position below the upper surface of the carriage and an extended position above the upper surface of the carriage. In the extended position, the retaining arms prevent the container from slipping forwardly off the front end of the carriage as the entire carriage is tipped forward for emptying. The apparatus further includes a safety mechanism that cooperates between the carriage and the base frame to prevent the carriage from tipping forward in reaction to the nonmovement of the retaining arms to the extended position caused when the container is positioned over the retaining arms.

The apparatus provides a safe device attachable to a powered vehicle for lifting, transporting and emptying containers without the danger of the container sliding forwardly off of the attachment, particularly when it is tipped for emptying. The apparatus is easy to attach to conventional forklifts and allows the operator to carry and empty the container without the necessity of dismounting the forklift.

BRIEF DESCRIPTION OF THE DRAWINGS

A better understanding of the present invention can be derived by reading the ensuing specification in conjunction with the accompanying drawings wherein.

DETAILED DESCRIPTION OF THE INVENTION

The container dumping apparatus in accordance with the present invention is an accessory device that can be mounted onto the forks of a conventional forklift in order to allow the forklift to be used for dumping containers in addition to carrying and lifting them. The apparatus includes a base frame, a carriage mounted on the base frame for receiving the container, retaining arms for securing the container on the upper surface of the carriage and a safety mechanism for preventing the tilting of the carriage when the container is positioned over the retaining arms.

Figure 1:
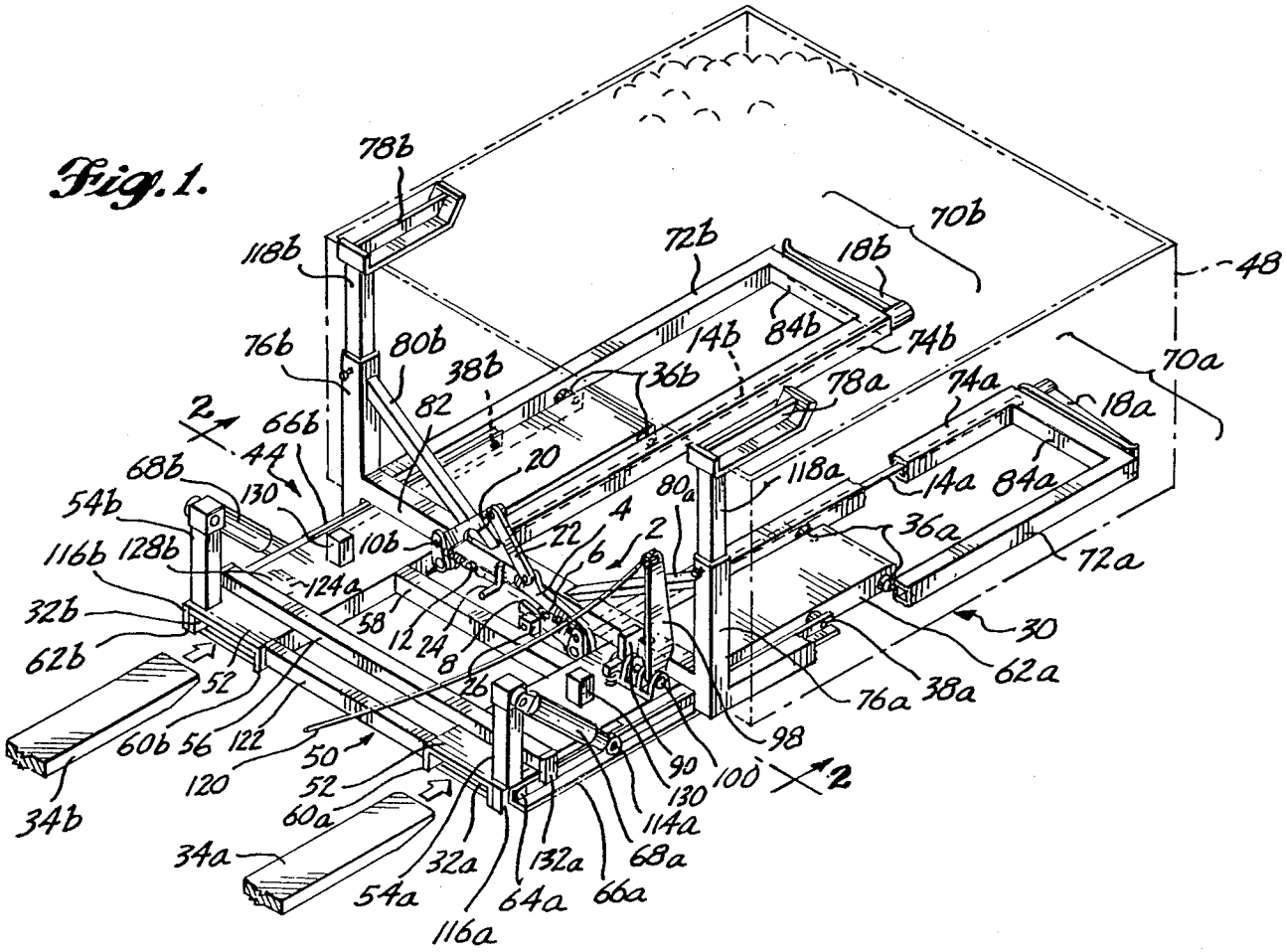
FIG. 1 is an isometric view of the container dumping apparatus in accordance with the present invention.

Referring to FIG. 1, carriage 30 is pivoted on a base frame 44 that includes a longitudinal channel 50 separating a pair of longitudinal sleeves **32*a* and 32*b* for receiving the forks 34*a* and 34*b* of a conventional forklift. On the aft end of each outer vertical side 62*a* and 62*b* of the longitudinal sleeves 32*a* and 32*b* is a longitudinal horizontal track 116a and 116b that slidably engages transverse pivots 64*a* and 64*b* about which the aft end of longitudinal control arms 66*a* and 66*b* is pivoted. The control arms 66*a* and 66*b* are members of fixed length having a vertical rib and a horizontal outwardly extending rib running the length of the arms. The fore ends of the vertical ribs extend forward to a point intermediate the center of the longitudinal sleeves 32*a* and 32*b* and the fore ends of the sleeves and are pivoted at points 38*a*** and 38*b* to the bottom of the carriage 30. The pivot points 38*a* and 38*b* cooperate with the pivoted aft ends of the control arms 66*a* and 66*b* for swinging above the upper surface 52 of the sleeves 32*a* and 32*b* when the carriage 30 tips forward. As the carriage 30 tips forward, the pivots 64*a* and 64*b* slide forward in the horizontal tracks 116*a* and 116*b* as the control arms 66*a* and 66*b* swing above the upper surface 52 of the sleeves 32*a* and 32*b*. When the carriage 30 is in a horizontal position, the control arms 66*a* and 66*b* lie on the external side of the horizontal tracks 116*a* and 116*b* in the same plane as the sleeves 32*a* and 32*b* with the pivots 64*a* and 64*b* positioned proximate the aft end of the tracks 116*a* and 11*b*.

On the upper surface 52 of each sleeve 32*a* and 32*b* opposite the channel 50 near the aft end of the sleeves 32*a* and 32*b* is mounted vertical members 54*a* and 54*b*. The pivoting of the control arms 66*a* and 66*b* and accordingly the tipping of the carriage 30 is damped by shock absorbers 68*a* and 68*b* mounted diagonally between the top of the vertical members 54*a* and 54*b* and the vertical rib of the control arms 66*a* and 66*b* at pivots 114*a* and 114*b* intermediate the pivots 64*a* and 64*b* and 38*a* and 38*b*. The horizontal tracks 116*a* and 116*b* extend forward of the pivots 114*a* and 114*b* and guide the forward sliding of the pivots 64*a* and 64*b* as the carriage 30 tips forward and the control arms 66*a* and 66*b* swing above the upper surface 52. A tranverse support beam 56 is connected to the upper surface of both control arms 66*a* and 66*b* by a beam support 132. The beam support 132 is an inverted L-shaped member whose vertical arm is welded to the outer upright surface of the control arms 66*a* and 66*b* such that the horizontally extending portion is directed inward toward the channel 50. The horizontal portion extends over the horizontal tracks 116*a* and 116*b* and resides above the upper surface 52 of the sleeves 32*a* and 32*b* to support the lower surface of the transverse support beam 56 above the upper surface 52. The transverse support beam 56 serves to prevent the control arms 66*a* and 66*b* from spreading, causing the pivots 64*a* and 64*b* to disengage horizontal tracks 116*a* and 11*b*. Forward of the support beam 56 on the beam support 132 is mounted a forwardly angled stop support 128 in which resides a rubber cushioned stop 124. The stop support 128 is positioned on the beam support 132 such that when the control arms 66*a* and 66*b* slide forward and consequently the stop 124 slides forward, the stop 124 will come in contact with a vertical stop post 130 mounted on the upper surface 52 of the sleeves 32*a* and 32*b*. The stop post 130 is positioned forward of the pivots 114*a* and 114*b* and serves to prevent the stop 124 and aft ends of the control arms 66*a* and 66*b* from sliding forward of the stop post 130. By limiting the forward sliding of the aft ends of control arms 66*a* and 66b*b*, the forward tipping of the carriage 30 (in FIG. 7) is restricted.

Just below the vertical members 54*a* and 54*b* in the channel 50 between the sleeves 32*a* and 32*b* is a transverse reinforcing beam 122 for providing structural support between the sleeves 32*a* and 32*b*. Forward of the transverse reinforcing beam 122 is another transverse reinforcing beam 58 located in the channel 50 connecting the interior vertical sides 60*a* and 60*b* of the sleeves 32*a* and 32*b* providing additional structural support to the base frame 44. On the forward surface of this transverse beam 58 offset to the right of the center and above its upper surface is mounted normally a base 26 for a forward extending cam follower 6. On the fore end of each sleeve 32*a* and 32*b* are the transverse pivots 36*a* and 36*b* for pivoting the carriage 30 on the base frame 44 as discussed in more detail hereinbelow.

The carriage 30 includes two longitudinal arms 70*a* and 70*b* parallel to the sleeves 32*a* and 32b*b*, each arm 70*a* and 70*b* including first and second parallel longitudinal beams 72*a* , b and 74*a*, b on opposite sides of the respective sleeve whose upper surfaces are coplanar with the upper surface 52 when the carriage 30 is in a horizontal position. The aft end of each outer beam 72*a* and 72*b* is just forward of the transverse reinforcing beam 58 and has mounted thereon a vertical track 76*a* and 76*b* for receiving a vertical shaft 118*a* and 118*b* connected to the aft end of a horizontal stabilizer 78*a* and 78*b* that extends forwardly over the upper surface of the container 48 when it is positioned on the carriage 30. The vertical tracks 76*a* and 76*b* are braced by diagonal trusses 80*a* and 80*b* positioned between the vertical tracks 76*a* and 76*b* and a horizontal transverse support beam 82 mounted between the vertical tracks 76*a* and 76*b* such that the lower surface of the support beam 82 is coplanar with the upper surface of the longitudinal beams 72*a* , b and 74*a*, *b*. When the carriage 30 is in a horizontal position, the lower surface of the support beam 82 resides on the upper surface 52. The fore ends of the longitudinal beams 72*a* , b and 74*a*, b extend forward past the fore ends of the sleeves 32*a* and 32*b* and are connected by transverse members 84*a* and 84*b*.

Still referring to FIG. 1, each longitudinal beam 72*a* , b and 74*a*, b of the carriage 30 is pivoted at 36*a* and 36*b* to the fore ends of the respective sleeves 32*a* and 32*b* aft of their longitudinal center. Intermediate the pivots 36*a* and 36*b* and the vertical tracks 76*a* and 76b*b*, each longitudinal beam 72*a* and 72*b* is pivoted at 38*a* and 38*b* to the fore end of the respective control arms 66*a* and 6*b*. The carriage 30 is thus pivoted to the base frame 44 such that the center of gravity of the container 48 when residing on the carriage 30 can cause the carriage 30 to tip forwardly.

Mounted on the inner longitudinal beams 74*a* and 74*b* of the carriage 30 are torque shafts 14*a* and 14*b* for transmitting rotation of movement from the fore end to the aft end of the carriage 30. The aft ends of the torque shafts 14*a* and 14*b* extend rearward past the transverse support beam 82 and are part of a safety mechanism 2, as will be described in more detail with reference to FIGS. 2 and 3, that cooperates with retaining arms 18*a* and 18*b* mounted on the fore ends of the torque shafts 14*a* and 14*b* that extend forward past the transverse members 84*a* and 84*b*. The safety mechanism 2 and the retaining arms 18*a* and 18*b* serve to prevent the carriage 30 from tipping forward when the container 48 is positioned over the retaining arms 18*a* and 18*b*. The retaining arms 18*a* and 18b are essentially longitudinal members having a length equal to the width of the arms 70*a* and 70b*b*, mounted perpendicular to the longitudinal axes of the torque shafts 14*a* and 14*b*. The retaining arms 18*a* and 18*b* are capable of rotating between a retracted position below the upper surface 52 of the carriage 30 and an extended position above the upper surface 52 of the carriage 30.

Figure 2:
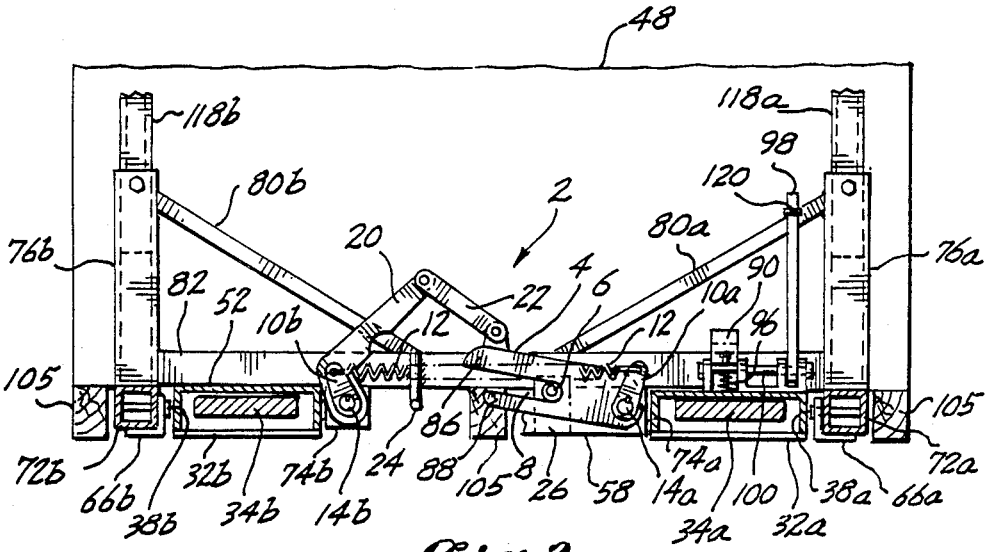
FIG. 2 is a rear view taken along line 2—2 in FIG. 1 of the container dumping apparatus in accordance with the present invention.
Figure 3:
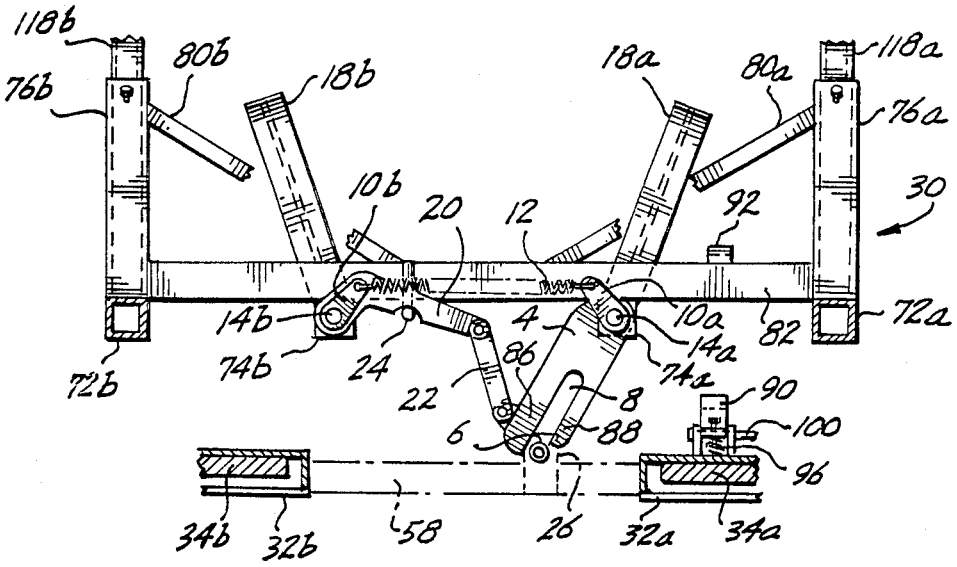
FIG. 3 is a rear view taken along line 2—2 in FIG. 1 of the container dumping apparatus with the container removed and the carriage tipped forward with the cam follower as a reference point in accordance with the present invention.

Additionally, referring primarily to FIGS. 2 and 3, the safety mechanism 2 that is transversely positioned rearwardly of the transverse support beam 82 and forward of the transverse reinforcing beam 58 between the sleeves 32*a* and 32*b*, includes a transverse cam arm 4 mounted on the aft end of the rightmost torque shaft 14*a* extending above the shaft and towards the center of the channel 50 oriented relative to the retaining arm 18*a* such that as the retaining arm 18*a* rotates upwardly above the upper surface 52 of the carriage 30, the cam arm 4 rotates downwardly. The aft end of torque shaft 14*a* is proximate the cam follower 6 mounted on the transverse reinforcing beam 58, such that a groove 8 in the cam arm 4 is capable of slidably engaging the cam follower 6. The groove 8 is between a longer upper finger 86 and a lower shorter finger 88 of the cam arm 4. The upper finger 86 opposite the end of the cam arm 4 that is mounted to the torque shaft 14*a* is pivotally coupled by coupler 22 to a secondary L-shaped lever 20 that is transversely mounted on the aft end of the leftmost torque shaft 14*b* rearwardly of the transverse support beam 82. The secondary lever also extends above the shaft 14*b* when the carriage 30 is in a horizontal position. The cam arm 4, secondary lever 20 and coupler 22 are in the same vertical plane and cooperate such that the downward or upward movement of either the secondary lever 20 or cam arm 4 causes a similar movement of the other member. The coupled end of the secondary lever 20 is above the coupled end of the cam arm when the carriage 30 is in a horizontal position such that none of the safety mechanism 2 extends below the lower surface of the sleeves 32*a* and 32*b* when the carriage 30 is in a horizontal position. The secondary lever 20, like the cam arm 4, is oriented relative to the retaining arm 18*b* on the fore end of torque shaft 14*b* such that as the retaining arm 18*b* rotates upwardly above the upper surface 52 of the carriage 30, the secondary lever 20 rotates downwardly. In order to prevent the retaining arms 18*a* and 18*b* from over-rotating past the extended position, the maximum downward rotation of the secondary lever 20 and, accordingly, the cam arm 4 through the coupler 22 is restricted by a stop 24 that extends rearwardly below the transverse support beam 82 and contacts the secondary lever 20 at the maximum point of downward rotation. The position of the cam arm 4 and the secondary lever 20 in the downwardmost position is such that the retaining arms 18*a* and 18*b* are in an extended position above the surface 52. The cam arm 4 and secondary lever 20 are biased to the downward position by transverse spring 12 that engages upwardly extending spring arms 10*a* and 10*b* mounted on the aft ends of the torque shafts 14*a* and 14*b* proximate the cam arm 4 and secondary lever arm 20. Although the present invention has been described with reference to a stationary cam follower 6 mounted to the base frame 44 and a cam arm 4 mounted on the aft end of the torque shaft 14*a*, other configurations, such as a cam follower mounted ot the torque shaft 14*a* by a transverse arm (not shown) and a stationary cam arm mounted on the base frame 44 are equally applicable.

Unless the cam arm 4 can disengage the cam follower 6, the upward movement of the cam arm 4 and accordingly the tipping of the carriage 30 from the horizontal position as illustrated in FIG. 3 is prevented. In order for the cam arm 4 to disengage the cam follower 6 it is necessary that the cam arm 4 and likewise the secondary lever 20 be free to rotate downward, thus allowing the groove 8 to be oriented so that the cam follower 6 will slide out of the cam arm 4 as the cam arm 4 moves upward with the carriage 30. Because the cam arm 4 and the secondary lever 20 are directly connected to the retaining arms 18*a* and 18*b* by the torque shafts 14*a* and 14*bb*, it is necessary for the downward movement of the cam arm 4 and secondary lever 20 that the retaining arms 18*a* and 18*b* be free to move upwardly from a retracted position into an extended position. Any obstruction of the movement of the retaining arms 18*a* and 18*b* to the extended position prevents the cam arm 4 and secondary lever 20 from moving downward and allowing the carriage 30 to tip forward. By preventing the tipping of the carriage 30 when the retaining arms 18*a* and 18*b* are not in their extended position, the safety mechanism 2 ensures that the container 48 will not accidentally slide forward off of the carriage 30 due to the retaining arms 18*a* and 18*b* being retracted.

Figure 4:
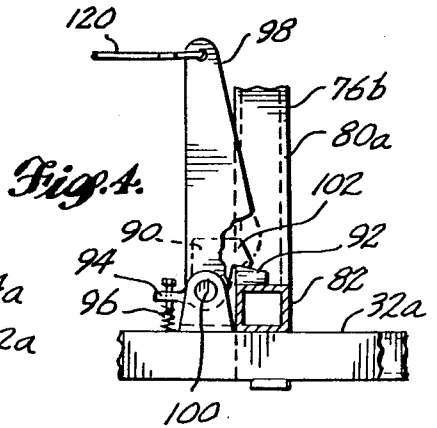
FIG. 4 is an elevational side view of the latch mechanism in a secured position in accordance with the present invention.

Referring to FIGS. 3 and 4, the upward movement of the carriage 30 from a horizontal position is primarily restricted by a latch 90 that is mounted for rotating forward or rearward on the upper surface 52 of the right-hand sleeve 32*a* rear of the point where the transverse support beam 82 resides on the base frame 44 when it is in a horizontal position. The upper portion of the latch 90 has a forwardly extending finger 102 that when positioned over a spacer 92 positioned on the top surface of the support beam 82, restricts the upward movement of the carriage 30 from the horizontal position. On the lower end of the latch 90 is a flange 94 that extends normally in a direction opposite that of the finger 102 and provides a surface against which a biasing spring 96 positioned between the flange 94 and the upper surface 52 serves to bias the finger 102 downward to secure the spacer 92. The release of the support beam 82 is effected by the rearward displacement of the latch 90 that is controlled by the vertical release handle 98 positioned to the right of the latch 90 on the upper surface 52 of the sleeve 32*a* . The release handle 98 has its lower end coupled to the lower end of the latch by a transverse shaft 100 such that the rotation of the shaft 100 by the rearward movement of the top of the release handle 98 causes the finger 102 of the latch 90 to pivot rearwardly, thus releasing the spacer 92 and allowing the carriage 30 to move upwardly. The upper end of the release handle 98 is provided with cable 120 for manual manipulation by the operator of the powered vehicle.

Figure 5:
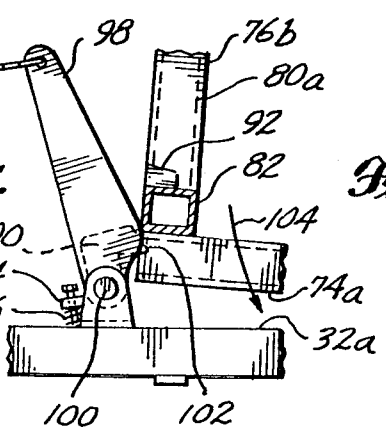
FIG. 5 is an elevational side view of the latch mechanism in a released position in accordance with the present invention.

Referring additionally to FIG. 5, the forward edge of the finger 102 is slanted downward in the forward direction, this slanting surface permits the lower surface of the transverse support beam 82 to bear down on and rearwardly displace the latch 90 as the carriage 30 returns to the horizontal position (arrow 104). After the carriage 30 has returned to the horizontal position, the biasing spring 96 causes the latch 90 to move forward, thus securely fastening the spacer 92 and preventing the upward movement of the carriage 30.

Figure 6:
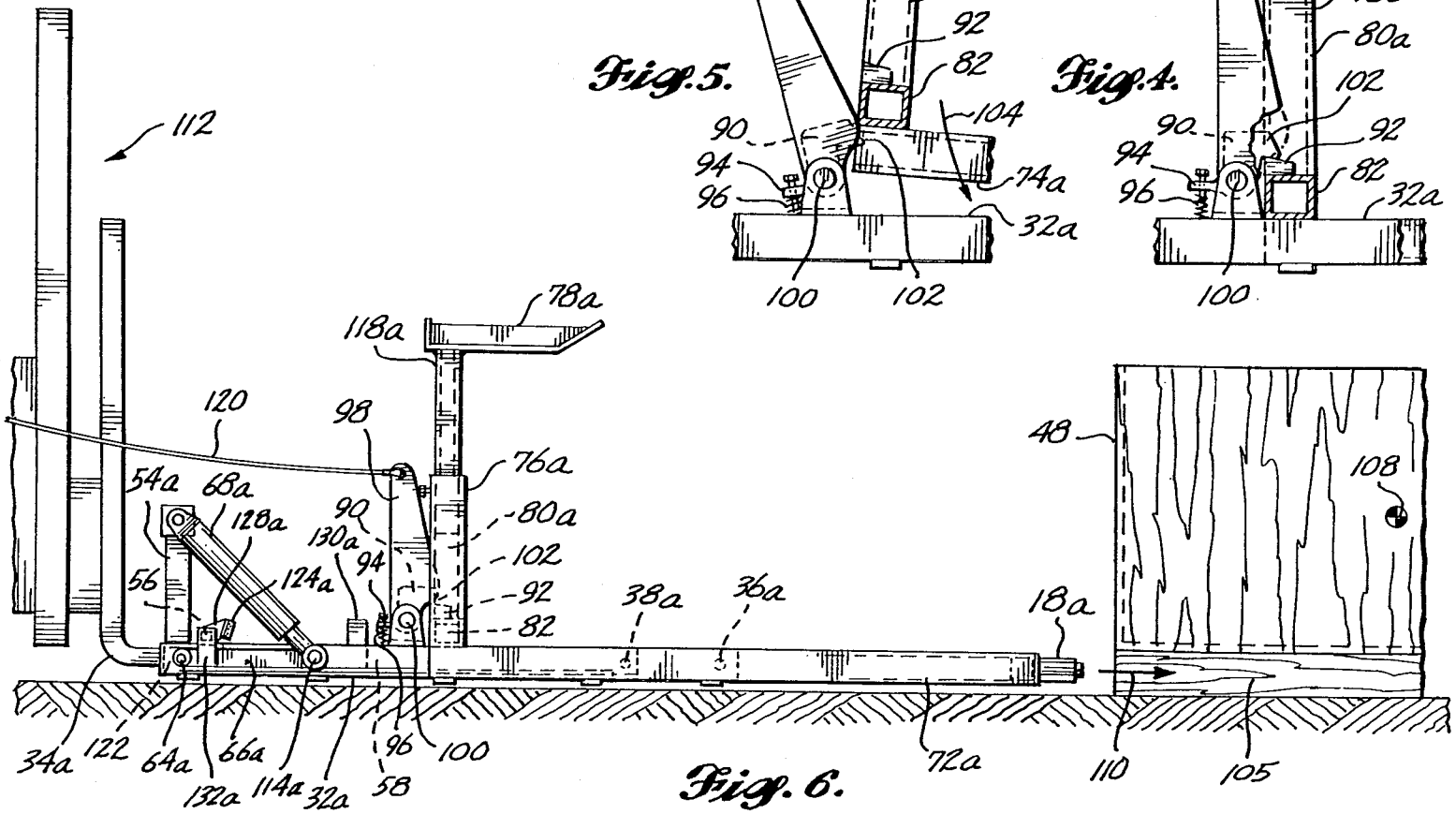
FIG. 6 is a side elevational view of the container dumping apparatus prior to receiving the container in accordance with the present invention.
Figure 7:
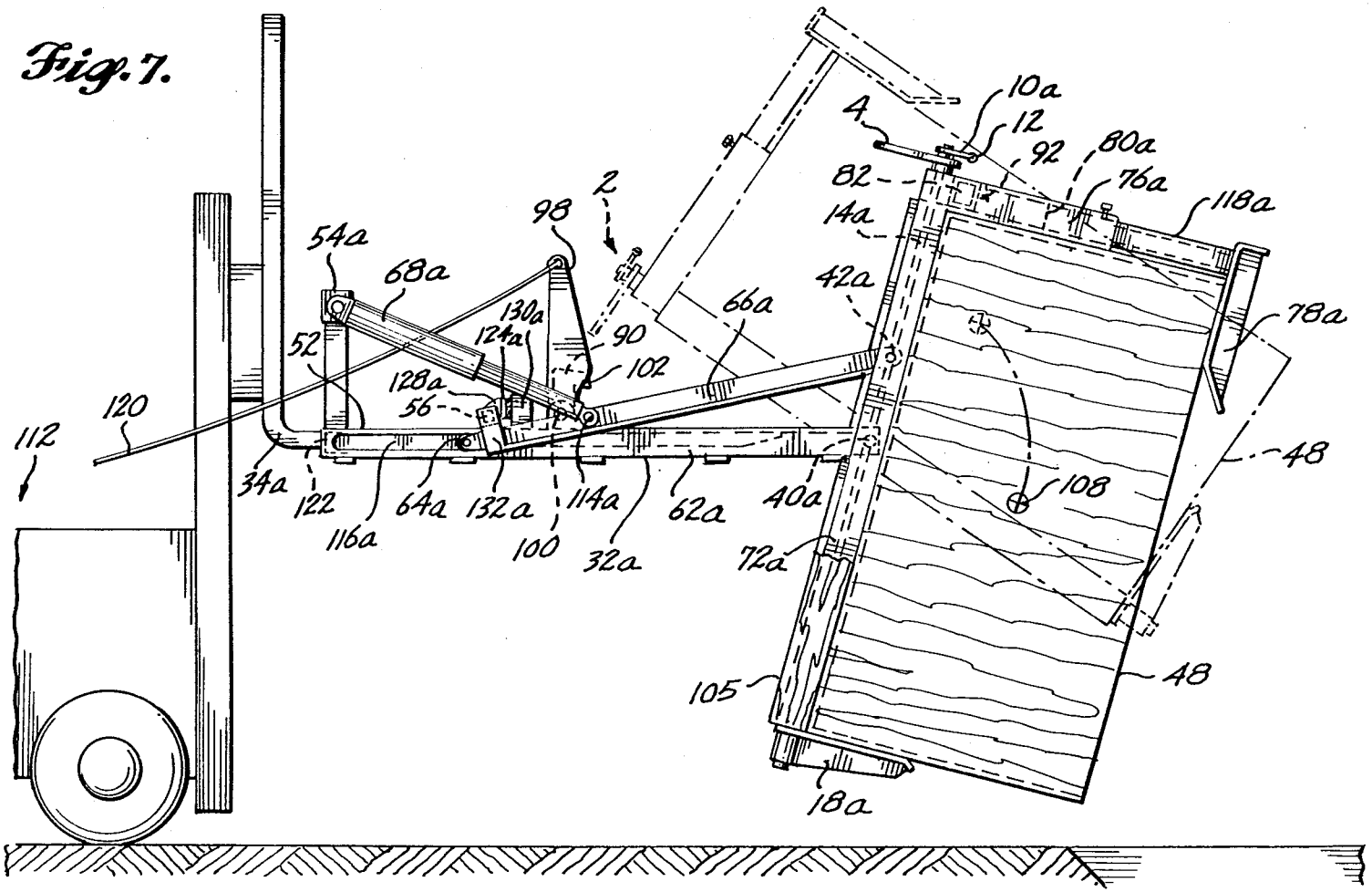
FIG. 7 is an environmental side view illustrating the operation of the container dumping apparatus in accordance with the present invention.

Now, referring to FIGS. 6 and 7, the carriage 30, in its secured horizontal position, with the retaining arms 18*a* and 18*b* in the retracted position, is aligned with the container 48 so that the arms 70*a* and 70*b* of the carriage 30 can be positioned underneath the container 48. The container 48 is normally elevated from ground level by several longitudinal beams 105 that are generally parallel to the direction in which the powered vehicle 112 must approach the container 48 to pick it up. In order to pick up the container 48 with its center of gravity indicated by cross mark 108, the motored vehicle 112 carrying the base frame 44 is directed forward in the direction of the arrow 110 causing the arms 70*a* and 70*b* to slide underneath the container 48 until the rear surface of the container 48 abuts the vertical tracks 76*a* and 76*b* on the aft end of the carriage 30. As the arms 70*a* and 70*b* are positioned underneath the container, the horizontal stabilizers 78*a* and 78*b* are accordingly positioned above the upper surface of the container 48 and serve to stabilize the container 48 when it is elevated by lifting the forks 34*a* and 34*b* of the powered vehicle.

Referring primarily to FIG. 1, when the container 48 is horizontally positioned correctly on top of the arms 70*a* and 70*b* for lifting and transporting, the retaining arms 18*a* and 18*b* maintain their retracted position. The latch 90 securely fastens the carriage 30 in the horizontal position until the operator elevates the base frame 44 and moves the top of the release handle 98 rearward, thus causing the latch 90 to release the spacer 92 and allow the container 48 to tip forward. The position of the center of gravity (108 in FIG. 7) forward of the pivots 36*a* and 36*b* causes the carriage 30 to tip forward if the container 48 does not restrict the upward movement of the retaining arms 18*a* and 18*b* by being positioned over them. Referring now to FIGS. 2, 3, 5 and 7, as the carriage 30 tips forward, the aft end of the carriage 30 including the safety mechanism 2 begins to be vertically displaced from the transverse reinforcing beam 58 to which the cam follower 6 is mounted. In conjunction with the vertical displacement, the cooperation between the biasing spring 12 and cam arm 4 causes the cam arm 4 to move downwardly thus causing the retaining arm 18*a* to swing upwardly into an extended position restricting the forward movement of the container 48. As the cam arm 4 moves downwardly, the coupler 22 between the cam arm 4 and the secondary lever 20 causes the secondary lever 20 to move downwardly, thus causing the retaining arm 18*b* to swing upwardly into an extended position also. The extended position of both retaining arms 18*a* and 18*b* serves to prevent the container 48 from sliding forwardly off of the arms 70*a* and 70*b* of the carriage 30 as it is tipped forward. As the container 48 is tipped past vertical (in FIG. 7), it is prevented from falling off of the carriage 30 by the retaining arms 18*a* and 18*b* in their extended positions and the horizontal stabilizers 78*a* and 78*b* engaging the upper surface of the container 48.

When the container 48 has been emptied, the carriage 30 and container 48 can be returned to the horizontal position either manually by the operator or by moving the powered vehicle rearward as the forks are lowered. As the carriage 30 returns to its horizontal position, the groove 8 in the cam arm 4 engages the cam follower 6 which causes the cam arm 4 and the secondary lever 20 to rotate upwardly and accordingly, the retaining arms 18*a* and 18*b* to rotate downward and return to their original positions (in FIG. 2). The lower surface of the carriage 30 first displaces the latch 90 and then is secured by latch 90 in the horizontal position. The powered vehicle can then be backed away from the container 48 and used to empty another container.

In situations where the container 48 prevents the retaining arms 18*a* and 18*b* from swinging upward to prevent the container 48 from sliding forward off of the arms 70*a* and 70b*b*, the safety mechanism 2 of the present invention prevents the forward tipping of the carriage 30. Referring primarily to FIGS. 1 and 2, if the container 48 is positioned over the retaining arms 18*a* and 18*b* because of misalignment or its nonconforming shape, the retaining arms 18*a* and 18*b* cannot rotate upward and consequently the cam arm 4 and secondary lever 20 are prevented from swinging downwardly and allowing the cam follower 6 to slide out of the groove 8 in the cam arm 4. Unless the cam arm 4 is able to disengage the cam follower 6, the upward movement of the transverse support beam 82 and the carriage 30 is prevented. This safety feature is particularly important when the operator of the powered vehicle has released the latch 90 enabling the carriage 30 to tip forward without knowing that the retaining arms 18*a* and 18*b* cannot be extended to prevent the container 48 from sliding off the front of the arms 70a and 70*b*.

Although the present invention has been described in a specific form and as operating in a specific manner for the purpose of illustration, it is to be understood that the invention is not limited thereto. The various modifications, such as utilizing only a single retaining arm or some other means of transmitting movement from the fore end of the carriage to the aft end of the carriage will suggest themselves to those skilled in the art without departing from the spirit of the present invention, the scope of which is set forth in the following claims.

The embodiments of the invention in which an exclusive property or privilege is claimed are defined as follows:

1. A container dumping apparatus for attachment to a powered vehicle comprising:

base frame and means for mounting said base frame on said vehicle;

carriage means pivotally mounted on said base frame for receiving a container of predetermined size, said carriage means pivoted to said base frame such that the weight of the container will cause the carriage means to tip forwardly, said carriage means having a fore end spaced forwardly from said base frame, and an aft end spaced rearwardly from the location at which said carriage means is pivoted to said base frame, said carriage means further having an upper surface for receiving said container;

retaining means mounted on the fore end of said carriage means for movement between a retracted position below said surface to an extended position above said surface to retain said container on said carriage means as it tips forwardly; and safety means cooperating between said carriage means and said base frame to prevent said carriage means from tipping in reaction to nonmovement of said retaining means to said extended position caused when said container is positioned over said retaining means.

2. The apparatus of claim 1, further comprising:

latch means for securing the aft end of said carriage means to said base frame.

3. The apparatus of claim 1, wherein the powered vehicle is a forklift.

4. The apparatus of claim 1, wherein the carriage means further comprises stabilizing means mounted on the aft end of said carriage means for securing the upper surface of the container.

5. The apparatus of claim 1, wherein said container comprises an open top.

6. The apparatus of claim 5, wherein said container is structurally independent of said carriage means.

7. The carriage means of claim 1, wherein said retaining means is mounted for pivotal movement about an axis oriented longitudinally relative to said carriage means for swinging movement through a predetermined arc.

8. The apparatus of claim 7, wherein said retaining means comprise longitudinal members.

9. the carriage means of claim 7, wherein said safety means includes a torque shaft coupled to said retaining means for transmitting the rotational movement of said retaining means from the fore end of said carriage means to the aft end of said carriage means.

10. The apparatus of claim 9, wherein said safety means further comprises:

a cam arm coupled to said torque shaft adjacent the aft end of said carriage means, said cam arm oriented relative to said retaining means such that as said retaining means rotates upwardly above said surface, said cam arm rotates downwardly; and a stationary follower mounted on said base frame and normally positioned above said cam arm when said carriage means is in a horizontal position.

11. The apparatus of claim 10, wherein said cam arm and said stationary cam follower cooperate to prevent said carriage means from tipping in reaction to the nonmovement of said retaining means to said extended position when said container is positioned over said retaining means.

12. the apparatus of claim 9, wherein said safety means further comprises a cam arm and a cam follower, said cam arm and said cam follower slidably engaging each other.

13. The apparatus of claim 12, wherein said cam arm and said cam follower cooperate to prevent said carriage means from tipping in reaction to nonmovement of said retaining means to said extended position when said container is positioned over said retaining means.

* * * * *

UNITED STATES PATENT AND TRADEMARK OFFICE

CERTIFICATE OF CORRECTION

PATENT NO. : 4,838,752

DATED : June 13, 1989

INVENTOR(S) : Harold C. Bryant

It is certified that error appears in the above-identified patent and that said Letters Patent is hereby corrected as shown below:

| Column | Line(s) | Error |
|---|---|---|
| 3 | 14 | "11b" should be --116b-- |
| 3 | 28 | "tranverse" should be --transverse-- |
| 3 | 42 | "11b" should be --116b-- |
| 4 | 5 | "32bb" should be --32b-- |
| 4 | 29 & 30 | "72a" should be --72a,-- |
| 4 | 33 | "76bb" should be --76b-- |
| 4 | 35 | "6b" should be --66b-- |
| 4 | 56 | "70bb" should be --70b-- |
| 5 | 51 | "ot" should be --to-- |
| 5 | 66 | "14bb" should be --14b-- |
| 6 | 31 | "32a ." should be --32a.-- |
| 7 | 57 | "70bb" should be --70b-- |
| 8 | 66 | "the" should be --The-- |
| 10 | 5 | "the" should be --The-- |

Signed and Sealed this

Twenty-fifth Day of September, 1990

*Attest:*

HARRY F. MANBECK, JR.

*Attesting Officer*

*Commissioner of Patents and Trademarks*